United States Patent [19]

De Lorenzo

[11] Patent Number: 4,502,679

[45] Date of Patent: Mar. 5, 1985

[54] MOTORIZED VARIABLE SPEED TREADMILL

[76] Inventor: Fred De Lorenzo, 26B Coromar Dr., Goleta, Calif. 93117

[21] Appl. No.: 420,860

[22] Filed: Sep. 21, 1982

[51] Int. Cl.[3] ..... A63B 23/06

[52] U.S. Cl. ..... 272/69; 188/67; 474/27

[58] Field of Search ..... 272/70; 128/25 R; 474/25, 27, 26; 188/67, 83

[56] References Cited

U.S. PATENT DOCUMENTS

| | | | |
|---|---|---|---|
| D. 231,678 | 5/1974 | Trotter | 272/69 UX |
| 1,629,323 | 5/1927 | Swartz | 188/67 X |
| 2,219,969 | 10/1940 | Vaughan | 188/67 X |
| 2,267,238 | 12/1941 | Irwin | 474/27 |
| 2,723,776 | 11/1955 | Jacobson | 188/67 X |
| 2,969,768 | 1/1961 | Grant | 272/69 X |
| 3,643,943 | 2/1972 | Erwin, Jr. et al. | 272/69 |
| 3,731,917 | 5/1973 | Townsend | 272/69 |
| 3,814,417 | 6/1974 | Catlin | 272/69 UX |
| 4,344,616 | 8/1982 | Ogden | 272/69 |
| 4,374,587 | 2/1983 | Ogden | 272/69 |

FOREIGN PATENT DOCUMENTS

| | | | |
|---|---|---|---|
| 966865 | 4/1975 | Canada | 272/69 |
| 767577 | 5/1934 | France | 272/69 UX |

OTHER PUBLICATIONS

Trotter Treadmills Incorporated, Model C-22 Kit, Holliston, Mass. 01746.

*Primary Examiner*—Robert A. Hafer
*Assistant Examiner*—Arnold W. Kramer
*Attorney, Agent, or Firm*—Harris, Kern, Wallen & Tinsley

[57] ABSTRACT

A motor driven treadmill having a speed control operated by the user and an elevation control operated by the user so that the user can vary the speed and the inclination of the treadmill as desired both at the start and during exercise. Spaced elevation units carried at one end of the treadmill frame with lead screws therein driven in synchronism by an electric motor, with limit controls for raising and lowering. A speed control with a pulley unit carried on a translating rod moved by the patient, and a brake mechanism for holding the translating rod in the position selected by the patient, thereby maintaining the desired speed.

10 Claims, 5 Drawing Figures

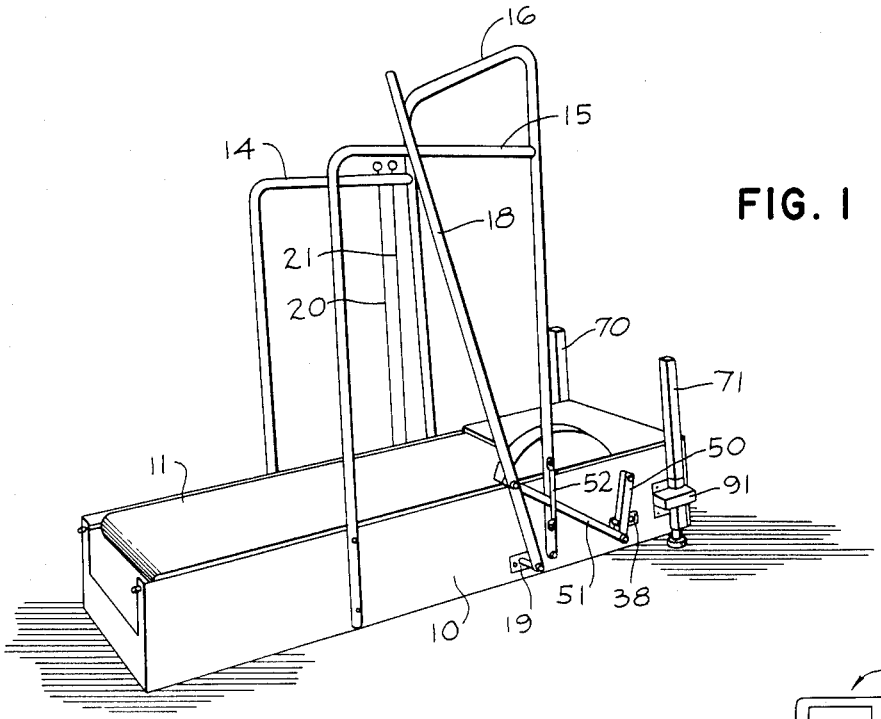
FIG. 1
FIG. 2
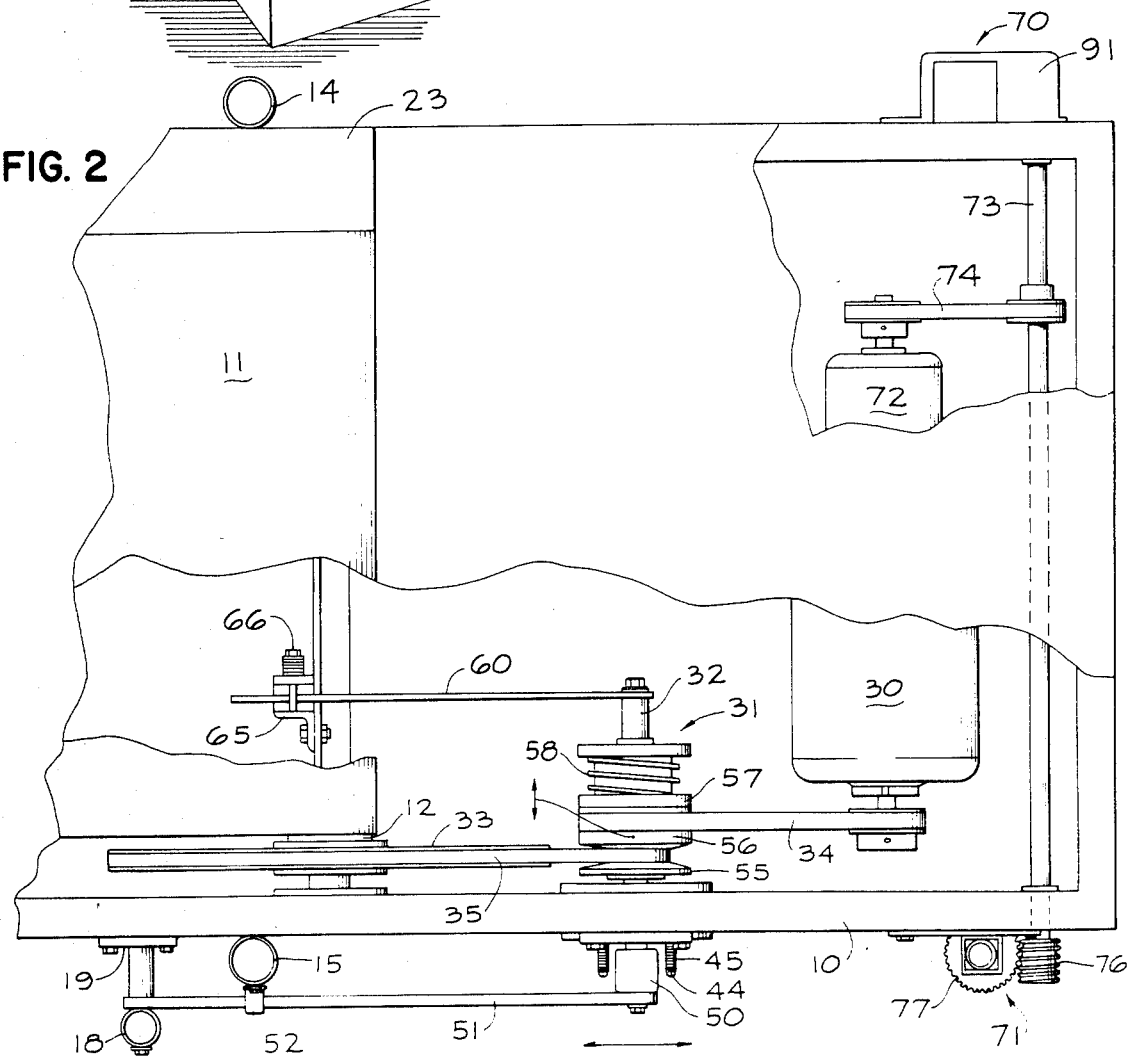

MOTORIZED VARIABLE SPEED TREADMILL

BACKGROUND OF THE INVENTION

This invention relates to treadmills of the type used for exercising, and in particular, to a new and improved treadmill which is motor driven at a controlled speed which forces the user to exercise at a predetermined level. Treadmills of this type are widely used in the diagnosis of heart, circulatory and respiratory functions, and in obtaining prescribed exercise for patients suffering heart, circulatory and/or respiratory problems, as well as for general exercise purposes.

In using a treadmill, it is desirable to be able to set the speed for walking, jogging or running. Also, it is desirable to be able to vary the speed during use in order to obtain and maintain a particular heart rate. While various speed control systems are known, one problem is that of providing a speed control system which does not require continuous monitoring in order to maintain the preset speed.

In addition to changing the speed of the treadmill, the effort required on the part of the patient to maintain position on the treadmill, and thereby the magnitude of the exercise, can be changed by varying the grade of the treadmill, that is by varying the elevation of the front end of the treadmill with respect to the rear end. Also, it is desirable to be able to change this grade during use of the equipment.

Accordingly, it is an object of the present invention to provide a new and improved motor driven treadmill having a simple and reliable speed control mechanism which is easily operated by the patient during use of the treadmill. A further object is to provide such a treadmill speed control mechanism with a braking or locking arrangement which serves to maintain the preset speed without requiring continuous monitoring by the patient.

It is a further object of the invention to provide a new and improved motorized treadmill with a motor driven mechanism for raising and lowering one end of the treadmill. An additional object is to provide such a treadmill with the lowering and raising mechanism under the control of the patient and operable during use, with the elevation mechanism maintaining the set elevation after adjustment.

These and other objects, advantages, features and results will more fully appear in the course of the following description.

SUMMARY OF THE INVENTION

One embodiment of the treadmill of the invention includes a frame, an endless belt carried in the frame on rollers, a motor for driving the endless belt, and lever means for controlling the speed of the endless belt. A rod is mounted in the frame for translating movement, a variable pulley unit is carried on the rod for rotation on the rod and has elements defining first and second grooves of variable widths, a first drive belt couples the motor to the first groove and a second drive belt couples the second groove to one of the endless belt rollers, and coupling means provides for coupling the speed control lever to the rod for translating the rod in the frame and varying the pulley ratios. An elongate brake member is carried on the rod with one end of the rod sliding in a brake shoe providing for clamping of the rod in the frame. Specific embodiments of the invention include details of the brake clamping and speed lever coupling configurations.

A further embodiment of the invention includes spaced elevation units carried at one end of the frame for raising and lowering the frame, and another motor and drive shaft carried in the frame, with the drive shaft and elevation units having interengaging means for actuating the elevation units to raise and lower one end of the frame. In the preferred embodiment, each elevation unit includes a housing fixed to the frame, a lead screw within the housing, and a gear mounted in the housing for rotation and threaded onto the lead screw, with the drive shaft providing for rotation of the gear to move the housing and frame relative to the lead screw. Specific embodimens may include limit switches for controlling elevation, and indicators for indicating the elevation in degree of grade, or otherwise as desired.

BRIEF DESCRIPTION OF THE DRAWINGS

FIG. 1 is a perspective view of a treadmill incorporating the presently preferred embodiments of the invention;

FIG. 2 is an enlarged top plan view of a portion of the treadmill of FIG. 1, with portions of the unit broken away to show details of the speed control and elevation unit;

DESCRIPTION OF THE PREFERRED EMBODIMENTS

Figure 3:
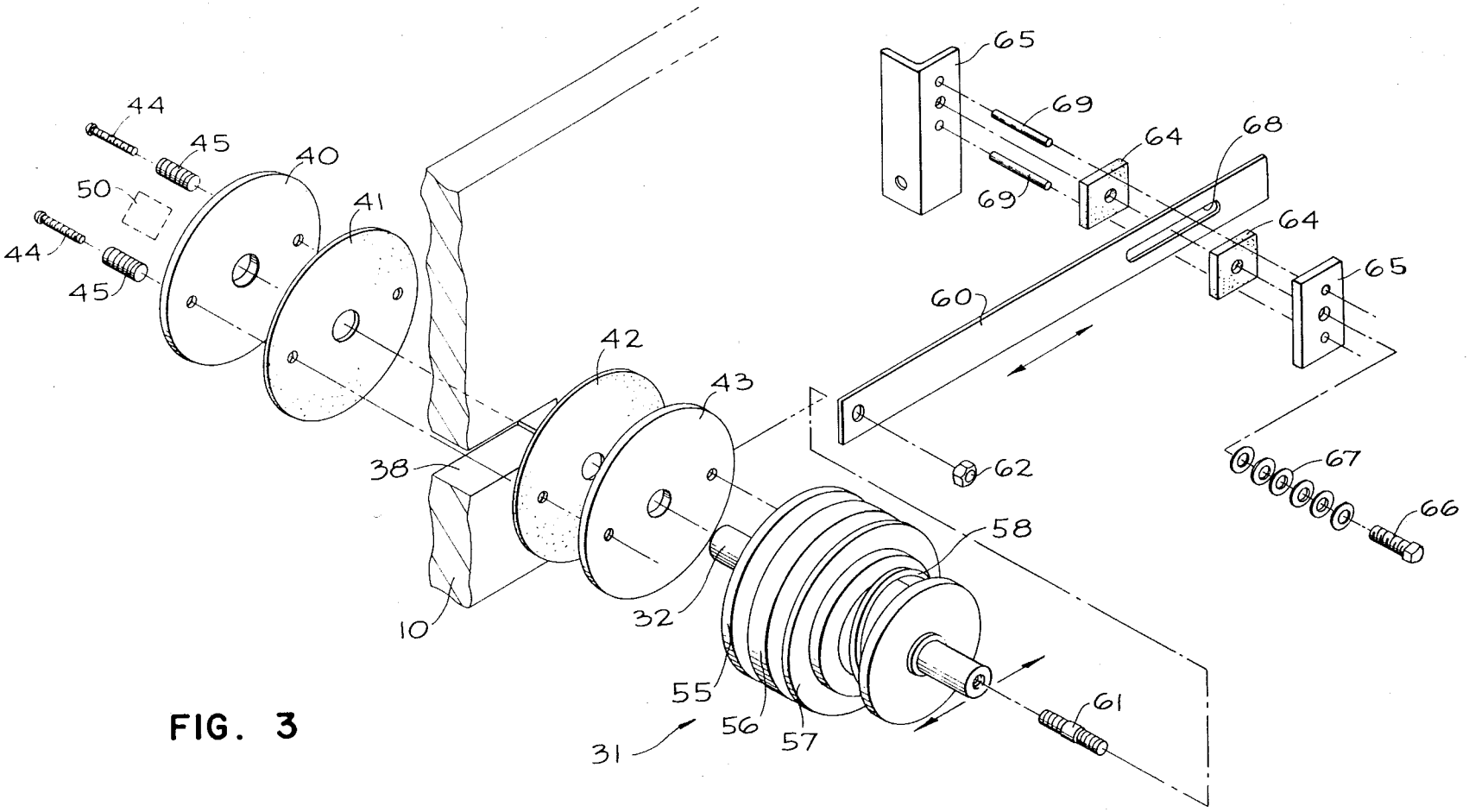
FIG. 3 is an enlarged and exploded view in perspective of the speed control of FIG. 2.

The treadmill includes a frame 10 with an endless belt 11 carried therein on rollers journaled in the frame, one of the rollers 12 being shown in FIG. 2. Longitudinal handrails 14, 15 and a transverse handrail 16 are carried on the frame 10. A speed control lever 18 is pivotally mounted on the frame at 19, and an on-off control rod 20 and an elevation control rod 21 are positioned on the opposite side of the frame and pass upward through the handrail 14.

In operation, the user straddles the belt 11 standing on the deck sections 23 on each side of the belt 11, and pulls up on the rod 20 to start the belt drive motor. The user may then adjust the belt speed by moving the lever 18 forward or backward, and may adjust the elevation of the front end of the treadmill by moving the rod 21 up or down. Then the user steps onto the endless belt and walks, jogs or runs, as required to maintain position on the belt. The handrails 14–16 may be used if desired and the speed and/or elevation may be varied while using, as to be described herein.

The endless belt drive includes a motor 30 mounted in the frame 10, a variable pulley unit 31 mounted on a rod 32, and a drive pulley 33 carried on the roller 12. The motor 30 is coupled to the variable pulley unit 31 by a belt 34 and the variable pulley unit is coupled to the drive pulley 33 by another belt 35. The rod 32 translates or slides generally horizontally in a slot 38 in the frame 10. A plate 40 and a pad 41 are positioned on the rod 32 on the exterior of the frame, and another pad 42 and a plate 43 are positioned on the rod 32 on the interior of the frame. The plate 40 and the pads 41, 42 are connected to the plate 43 by screws 44, with the screws passing through spacers 45 and openings in the plate 40 and pads 41, 42 and threaded into openings in the plate 43.

A link 50 is pivotally mounted to the frame at its upper end, and is pivotally connected to another link 51 at the lower ends of the two links. The link 51 is pivotally connected to the lever 18 at the upper end of the link, and this link 51 may be positioned under a retainer 52 carried on one of the handrails. The link 50 is positioned between the screws 44 and spacers 45, as best seen in FIG. 2.

With this arrangement, movement of the lever forward or backward produces a corresponding movement of the rod 32 forward or backward.

The variable pulley unit 31 rotates on the rod 32 and includes pulley members 55, 56 and 57, with a spring 58 urging the members 57 and 56 toward the member 55. The belt 34 rides in the V groove formed by the members 56, 57 and the belt 35 rides in the V groove formed by the members 55, 56. Movement of the rod 32 in the frame 10 changes the drive ratio between the motor 30 and the endless belt roller 12. As the rod 32 moves to the left from the position shown in FIG. 2, the pulley section 56 is forced toward the pulley section 55, reducing the diameter of the V groove between the sections 57, 56 and increasing the diameter of the V groove between the sections 56, 55, thereby achieving the desired change in speed. Movement of the rod in the opposite direction causes movement of the pulley section 56 in the opposite direction and a corresponding opposite change in speed.

One problem encountered with this type of speed control unit is creep or undesired change of speed during operation of the treadmill. This problem is overcome in the present unit by incorporating a brake on the rod 32. A brake member 60 is attached to the inner end of the rod 32 by a stud 61 and nut 62, with the stud threaded into the rod and the nut retaining the brake member on the stud. The other end of the brake member 60 is clamped between pads 64 and plates 65 by a bolt 66 and a plurality of concave or spherical spring washers 67. One of the plates 65 is mounted to the frame and the bolt 66 passes through the washers 67 and aligned openings in the other plate 65, one of the pads 64, a slot 68 in the brake member 60, an opening in the other pad 64, and a threaded opening in the plate 65. Guide pins 69 may be positioned between the plates 65 on opposite edges of the brake member 60 is desired. The clamping pressure exerted on the brake member by the pads may be adjusted by means of the bolt 66.

With the brake member 60 clamped in the brake shoe unit formed by the pads and springs, a substantial resistance to movement of the rod 32 is achieved. It has been determined that this type of braking system is adequate to prevent creep of the speed control system during operation. However, the resistance of the braking system is readily overcome by the user actuating the speed control lever 18 to adjust the speed as desired.

Elevation units 70, 71 are mounted on opposite sides of the frame 10 adjacent the front end of the frame. The elevation units are actuated by another motor 72 mounted in the frame 10 and driving a drive shaft 73 via a drive belt 74. The drive shaft 73 is journaled in the frame and in the embodiment illustrated, carries a worm gear 76 at each end for engagement with a mating gear 77 in the elevation unit.

Figure 5:
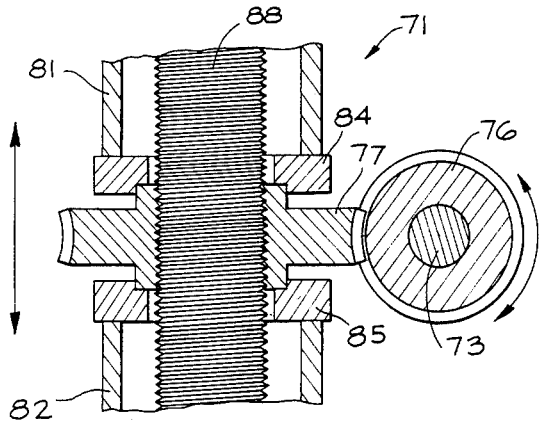
FIG. 5 is an enlarged partial sectional view taken along the line 5—5 of FIG. 4.
Figure 4:
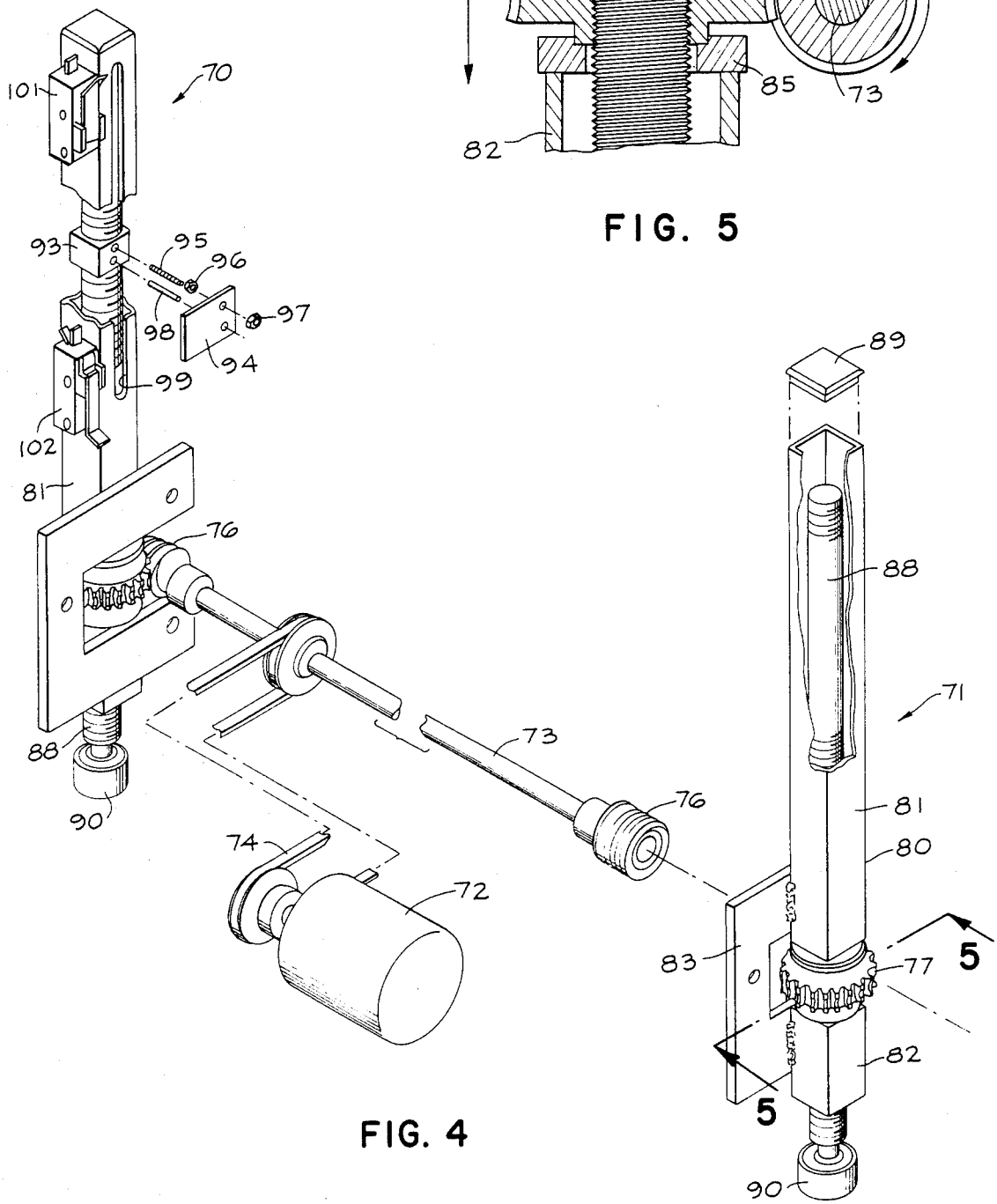
FIG. 4 is an enlarged and exploded perspective view of the elevation system of FIG. 2.

The elevation unit 70, 71 may be identical, and the unit 71 is described in greater detail. A housing 80 comprising an upper section 81 and a lower section 82 fixed to a plate 83, is attached to the side of the frame 10. The gear 77 is journaled in bushings 84, 85, as best seen in FIG. 5, with the gear 77 threaded onto a lead screw 88. The upper end of housing section 81 may be closed by a cap 89, and a pad 90 may be carried on the lower end of the lead screw 88. Covers 91 may be provided for enclosing the gears.

In operation, the front end of the treadmill rests on the pads 90. Energizing the motor 72 rotates the drive shaft 73 which in turn rotates the gears 77, moving the gears upward or downward on the lead screws 88. Translation of the gears 77 along the lead screws 88 also causes upward or downward movement of the housing 80 and the forward end of the frame 10. This permits the user of the treadmill to change the grade or angle of elevation of the treadmill as desired, by means of the control rod 21 which energizes the motor 72 in the forward or reverse direction.

In the preferred embodiment, a limit control is utilized for limiting upward and downward movement of the forward end of the frame with respect to the lead screws. A block 93 is carried at the upper end of one of the lead screws 88 on a non-threaded section of the lead screw so that the block does not translate relative to the lead screw. A cursor 94 is attached to the block 93 by a screw 95 and nuts 96, 97, with the screw 95 and a guide pin 98 riding in a slot 99 of the upper housing section 81. Lever actuated switches 101, 102 are mounted on the housing section 81 at desired locations, with the switches electrically connected into the control circuit for the motor 72 for shutting off power to the motor when either switch is actuated. The cursor 94 is positioned so that it will actuate the switch 101 when the forward end of the treadmill has moved to the lower limit, and will actuate the switch 102 when the forward end of the treadmill has moved to the upper limit. If desired, an elevation indicator calibrated in inches or in degrees may be mounted on the housing, with the cursor giving an indication of the position of the treadmill.

I claim:

1. In a treadmill having a frame, an endless belt carried in said frame on rollers, a first motor for driving said endless belt, and lever means pivotted to said frame for controlling the speed of said endless belt, the improvement comprising in combination:

a rod mounted in said frame and spaced parallel to said rollers and motor for translating perpendicular to said rollers;

a variable pulley unit carried on said rod for rotation on said rod, said variable pulley unit having means defining first and second grooves of variable widths, with the width of said first groove varying inversely with the width of said second groove; a first drive belt coupling said first motor and first groove;

a second drive belt coupling said second groove and one of said endless belt rollers;

an elongate brake member mounted in said frame perpendicular to said rod and said rollers and having first and second ends with said first end connected to said rod for translation with said rod to maintain said rod in the position selected by the user;

a brake shoe unit mounted in said frame, with said second end of said brake member sliding in said brake shoe unit when moved by the user and for holding the brake member and rod in the adjusted position; and means for coupling said lever means to said rod for translating said rod in said frame and thereby said brake member.

2. A treadmill as defined in claim 1 wherein said brake member has a slot at said second end, and said brake shoe unit includes a first pin sliding in said slot, first and second pads positioned on opposite sides of said brake member with said first pin passing therethrough, and clamp means compressing said pads together onto said brake member.

3. A treadmill as defined in claim 2 wherein said clamp means includes first and second plates on opposite sides of said pads, with said first pin having a head outside said first plate and having an opposite end positioned in said second plate, and a spring means compressed between said head and first plate.

4. A treadmill as defined in claim 3 wherein said spring means comprises a plurality of spherical washers on said first pin.

5. A treadmill as defined in claim 3 including second and third guide pins between said first and second plates and at opposite edges of said brake member.

6. A treadmill as defined in claim 3 including:

a drive shaft mounted in said frame;

a second motor carried in said frame for driving said draft shaft in rotation; and first and second spaced elevation units carried at one end of said frame for raising and lowering frame;

said drive shaft and elevation units including interengaging means for actuating said elevation units to raise or lower said frame end when said second motor is energized.

7. A treadmill as defined in claim 1 including:

a drive shaft mounted in said frame;

a second motor carried in said frame for driving said draft shaft in rotation; and first and second spaced elevational units carried at one end of said frame for raising and lowering such frame;

said drive shaft and elevation units including interengaging means for actuating said elevation units to raise or lower said frame end when said second motor is energized.

8. A treadmill as defined in claim 7 wherein each of said elevation units includes a housing fixed to said frame, a lead screw within said housing, and a first gear mounted in said housing and threaded onto said lead screw, with said drive shaft including a second gear engaging said first gear.

9. A treadmill as defined in claim 8 including an elevation limit control comprising a block rotating on said lead screw, a pin projecting from said block and riding in a slot in said housing, first and second limit switches mounted on said housing spaced from each other, and a switch actuator unit carried on said pin and engagable with said first and second switches as said housing moves relative to said lead screw.

10. In a treadmill having a frame, an endless belt carried in said frame on rollers, a first motor for driving said endless belt, and lever means for controlling the speed of said endless belt, the improvement comprising in combination:

a slotted frame member in said frame;

a rod mounted in said frame for translating in said slotted frame member;

a variable pulley unit carried on said rod for rotation on said rod, said variable pulley unit having means defining first and second grooves of variable widths, with the width of said first groove varying inversely with the width of said second groove;

a first drive belt coupling said first motor and first groove;

a second drive belt coupling said second groove and one of said endless belt rollers;

an elongate brake member having first and second ends with a slot at said second end and with said first end connected to said rod for translation with said rod to maintain said rod in the position selected by the user;

a brake shoe unit mounted in said frame, with said second end of said brake member sliding in said brake shoe unit when moved by the user and for holding the brake member and lever means in the adjusted position;

said brake shoe unit including a first pin sliding in said slot, first and second pads positioned on opposite sides of said brake member with said first pin passing therethrough, and clamp means compressing said pads together onto said brake member, said clamp means including first and second plates on opposite sides of said pads, with said first pin having a head outside said first plate and having an opposite end positioned in said second plate, and a spring means compressed between said head and first plate; and means for coupling said lever means to said rod for translating said rod in said frame and thereby said brake member, said coupling means including third and fourth pads carried on said rod on opposite sides of said frame member, spaced screw means clamping said third and fourth pads to said pulley unit, with said screw means projecting outward from said frame, and a link pivoted to said frame and positioned between said first and second screw means and driven by said lever means.

* * * * *